US005527201A

United States Patent [19]

Maddock

[11] Patent Number: 5,527,201

[45] Date of Patent: Jun. 18, 1996

[54] TOY CONSTRUCTION KIT WITH INTERCONNECTING BUILDING PIECES

[76] Inventor: Paul T. Maddock, 943 Raymo Road, Windsor, Ontario, Canada, N8Y 4A7

[21] Appl. No.: 220,513

[22] Filed: Mar. 31, 1994

Related U.S. Application Data

[63] Continuation-in-part of Ser. No. 135,359, Oct. 13, 1993, which is a continuation-in-part of Ser. No. 829,316, Feb. 3, 1992, abandoned.

[30] Foreign Application Priority Data

Nov. 25, 1991 [GB] United Kingdom ..... 9124966

[51] Int. Cl.[6] ..... A63H 33/12; A63H 33/08

[52] U.S. Cl. ..... 446/104; 446/111; 446/126; 446/127

[58] Field of Search ..... 446/104, 102, 446/85, 105, 106, 107, 111, 112, 115, 116, 118, 120, 121, 122, 124, 125, 126, 127, 128

[56] References Cited

U.S. PATENT DOCUMENTS

| | | | |
|---|---|---|---|
| 2,028,229 | 1/1936 | Luhn | 446/112 X |
| 2,075,259 | 3/1937 | Battjes | 446/102 X |
| 2,472,363 | 6/1949 | Blackinton | 446/127 |
| 3,657,838 | 4/1972 | Hanning et al. | 446/127 X |
| 3,670,449 | 6/1972 | Lemkin et al. | 446/126 X |
| 4,214,403 | 7/1980 | Knudsen | 446/121 X |
| 4,712,336 | 12/1987 | Backer | 446/122 X |
| 4,758,196 | 7/1988 | Wang | 446/104 |
| 4,764,143 | 8/1988 | Gat et al. | 446/102 |
| 4,833,856 | 5/1989 | Zwagerman | 446/127 X |

FOREIGN PATENT DOCUMENTS

| | | | |
|---|---|---|---|
| 2131688 | 12/1972 | Germany | 446/122 |
| 941847 | 11/1963 | United Kingdom | 446/118 |

*Primary Examiner*—Mickey Yu
*Assistant Examiner*—D. Neal Muir
*Attorney, Agent, or Firm*—R. Craig Armstrong

[57] ABSTRACT

Toy building pieces are disclosed which may be advantageously used in conjunction with POPSICLE sticks, their generic equivalents, or other framing pieces or connectors. One or more faces of many of the building pieces have apertures defined in the surface thereof to receive a framing piece such as a POPSICLE stick or connectors which are I-shaped in cross-section. Other faces of the piece may incorporate piece interconnection means, which may include for example: a pin on one part adapted to engage a sleeve on another part, for hinged connection; a dovetail tongue on one part adapted to engage a dovetail groove on another part; or a tongue projecting from a face to engage one of the apertures. Other interconnection means are also contemplated. Adapter pieces are provided to change the connection means of a piece, in effect. In a kit or collection of such building pieces, a combination of various configurations of such pieces is provided.

20 Claims, 14 Drawing Sheets

TOY CONSTRUCTION KIT WITH INTERCONNECTING BUILDING PIECES

REFERENCE TO RELATED APPLICATIONS

This is a continuation-in-part of application Ser. No. 08/135,359, filed Oct. 13, 1993, which was a continuation-in-part of application Ser. No. 07/829,316, filed Feb. 3, 1992 now abandoned.

BACKGROUND OF THE INVENTION

1. Field of the Invention

This invention relates to toy building blocks, and in particular to interconnecting blocks which provide multiple connection means.

In their preferred embodiment, the blocks may be advantageously used in conjunction with POPSICLE (trademark) sticks, their generic equivalents, or other connectors, including tongues projecting from other blocks, and specially configured connectors. Such connectors could include larger craft sticks, ¾ inch by 1/16 inch by six inches, for example, in scaled-up versions of the blocks which are particularly suitable for younger children.

2. Description of the Prior Art

Toy building blocks of many different configurations are of course very well known and popular, and have always been one of the most popular toys in a wide variety of cultures. The building blocks take many different forms, and some of these forms have become extremely well known in association with their respective trademarks, e.g LEGO, DUPLO, MINIBRIX, etc.. The blocks employ various interconnection means to permit them to be snapped together in a fixed relationship in order to build structures.

Building toys also exist which employ hinged connections between the parts. For example, the ZAKS (trademark) parts have complementary projecting tongue pieces which snap together to define a hinge, and certain LEGO parts connect together in a hinged manner as well.

A number of building toys employ connector pieces which permit structures to be assembled from larger framing pieces. For example, the well-known TINKERTOY (trademark) parts use various connectors having cylindrical openings therein to receive small-diameter wooden framing pieces akin to dowel rods, typically with about a ¼ inch diameter.

The many prior art building toys have many obvious attractions, and should not be criticized. However, there is always a demand for new building toys which may offer different possibilities from the prior art.

The present invention can be used to build many novel structures, whether or not employing POPSICLE sticks or generic equivalents thereof, or other connectors, with various interconnection options. The inventor is not aware of any system having the unique combination of features in the invention.

SUMMARY OF THE INVENTION

It is an object of the invention to provide a novel construction toy which will provide an attractive alternative to the various prior art building blocks.

It is a further object of the invention to provide interconnecting building blocks which may be advantageously used in conjunction with POPSICLE sticks, their generic equivalents, or other connectors or framing pieces, if desired, or which may be connected to each other without the use of such intermediate connectors. As mentioned above, such connectors could include larger craft sticks, ¾ inch by 1/16 inch by six inches, for example, in scaled-up versions of the blocks which are particularly suitable for younger children.

The invention includes a number of individual pieces of various configurations, and a kit comprising various individual pieces, including connector pieces.

At least some of the individual pieces preferably have one or more faces with apertures defined therein to receive an connector or elongated framing piece such as a POPSICLE stick. Other faces of the pieces also incorporate connection means, for connecting blocks to each other to form larger building units.

The interconnection means may include a pin projecting from one part, particularly sized to engage a sleeve incorporated in another part, for hinged connection so that one block may rotate with respect to another block. The pin and sleeve preferably are slightly tapered such that a snug fit is achieved at full engagement between said pin and said sleeve.

The interconnection means may also or alternatively include a male dovetail tongue on one part particularly sized to engage a female dovetail groove on another part, for connection such that one block may slidably engage with another block. In one configuration, several sides of the block, preferably four, have dovetail connections, and the connections are specifically dimensioned to permit the blocks to be interconnected in overlapping fashion to form a matrix of blocks.

The interconnection means may also include a tongue projecting from a face to engage one of the apertures. The tongue may be shaped like or generally similar to the end of a POPSICLE stick or the like, if desired.

Other interconnection means are also contemplated, including interconnection of the LEGO type, as one example.

Connector pieces may be provided, specifically configured to engage in slots which preferably are I-shaped in cross-section, or to engage in one of two such slots which may be oriented at ninety degrees to each other to form a cross shape with T-shapes at the end of each arm of the cross.

In a kit of such building blocks, a combination of various configurations of such blocks is provided. Pieces may be connected to each other to create larger building units in which each building unit has at least two different interconnection means configured for connection to complementary interconnection means on other pieces or building units.

Further features of the invention will be described or will become apparent in the course of the following detailed description.

For convenience, the specification will refer to POPSICLE sticks. However, it should be clearly understood that this is intended to include generic equivalents as well, namely any sticks having substantially the same general shape and dimensions as POPSICLE sticks, and for that matter any other connector or elongated framing pieces which could be adapted to engage in the apertures within the blocks. As will be clear from the detailed description, POPSICLE sticks are just one example of the connectors which may be used, connectors having an H-shaped cross-section being another example which will be described in detail herein. Such connectors could also include larger craft sticks, in scaled-up versions of the blocks.

Also, the word "block" will be used generally for convenience, although the word "piece" will also be used interchangeably. The word "piece" is perhaps more accurate, since not all of the pieces are shaped like a "block". Use of the word "block" is not intended to limit the invention to pieces which are shaped like a "block".

BRIEF DESCRIPTION OF THE DRAWINGS

In order that the invention may be more clearly understood, the preferred embodiment thereof will now be described in detail by way of example, with reference to the accompanying drawings, in which:

FIG. 3 is a perspective view of a block which is longer than the block of FIG. 2, but which is otherwise quite similar;

DETAILED DESCRIPTION

The invention comprises a wide variety of configurations of building blocks, each combining various features, such that a kit comprising blocks of a number of various configurations permits a wide variety of different structures to be assembled according to the whims of the person. Many of the blocks are adapted to receive framing members such as POPSICLE sticks, or other connectors such as tongues projecting from other blocks.

So that various structures can be formed, whether or not using POPSICLE sticks or the like, the blocks incorporate interconnection means. If desired, only one form of connection could be used, but that would limit the interconnections options and thus the variety of structures which could be built. In a kit, of course, it may be perfectly acceptable to have a number of blocks which have only one form of connection, and long as there are some which have several forms of connection.

Figure 1:
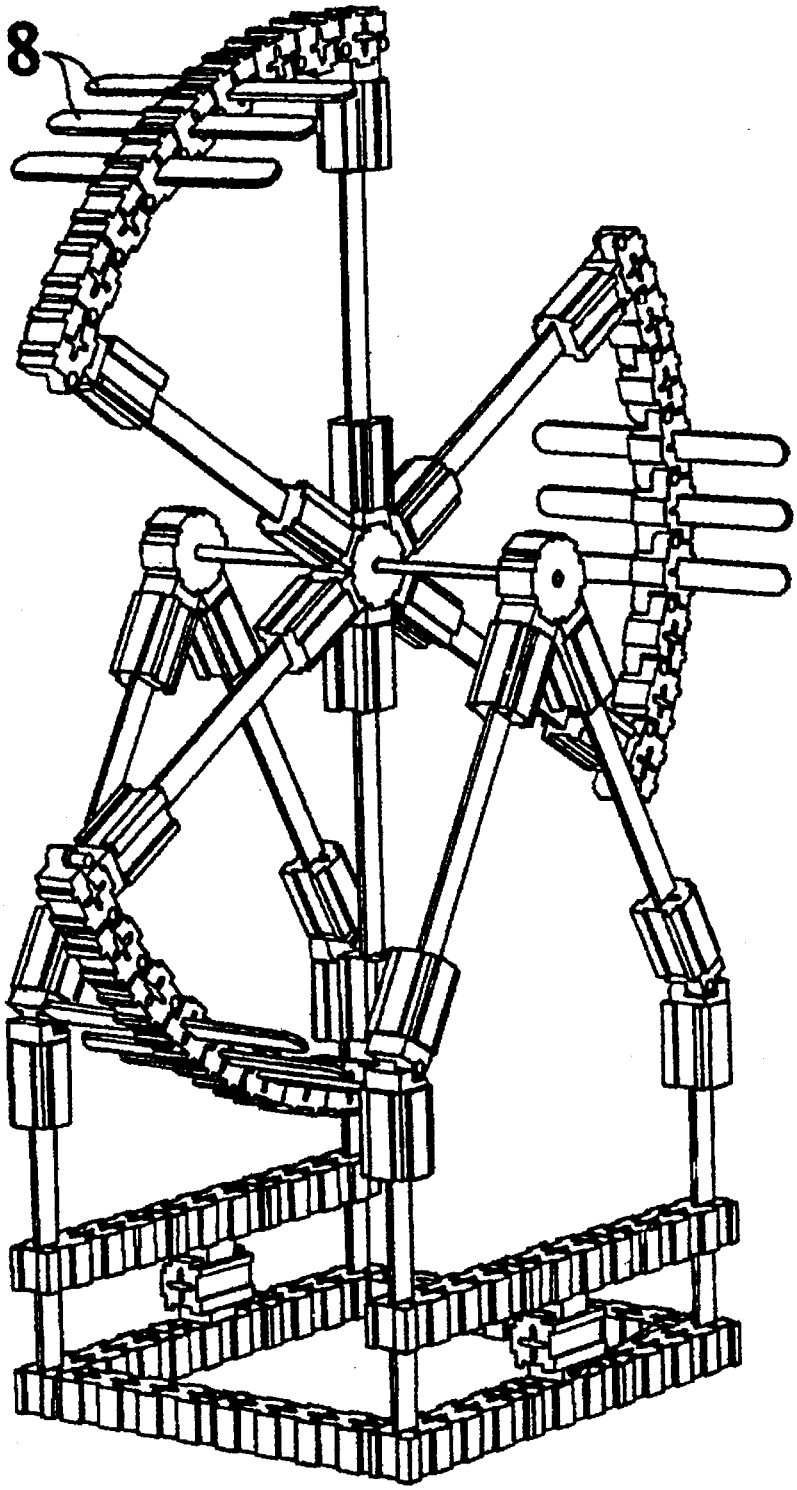
FIG. 1 shows a "Ferris wheel" assembled from various blocks according to the invention, as an example of one of a nearly infinite number of structures which could be built using the invention, and further illustrates the individual blocks which make up the wheel.
Figure 1A:
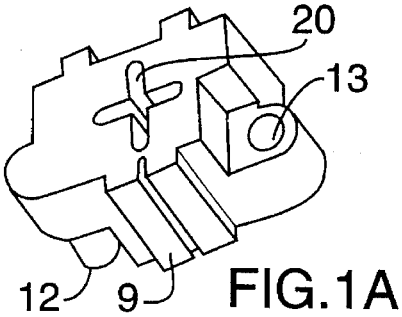
Figure 1B:
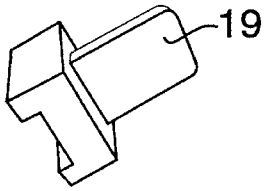
Figure 1C:
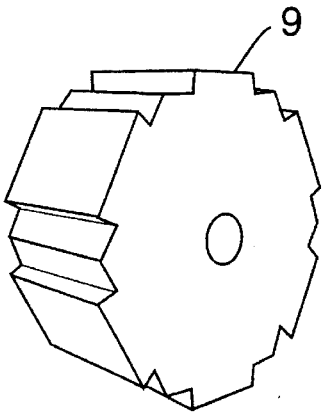
Figure 1D:
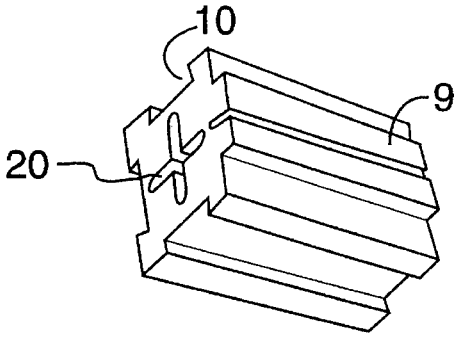
Figure 1E:
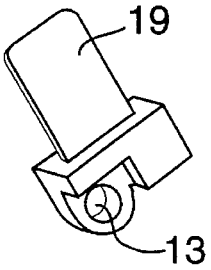
Figure 1F:
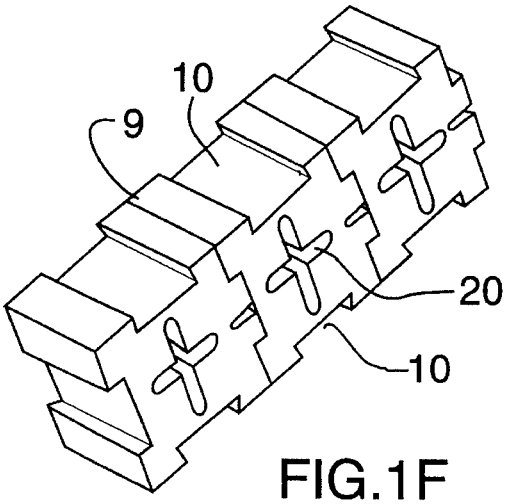
Figure 1G:
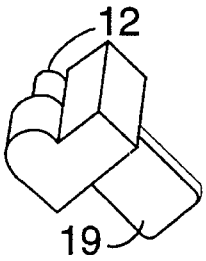
Figure 1H:
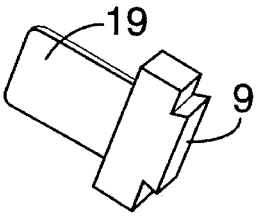

FIG. 1 shows a "Ferris wheel" assembled from various blocks according to the invention, and the individual blocks which make up the wheel. From FIG. 1, it should be appreciated that various pieces which make up the invention can be connected together in many different ways.

FIGS. 2–8 show individual blocks in greater detail. These blocks constitute a kit which can be used to assemble a nearly infinite variety of structures.

Figure 2:
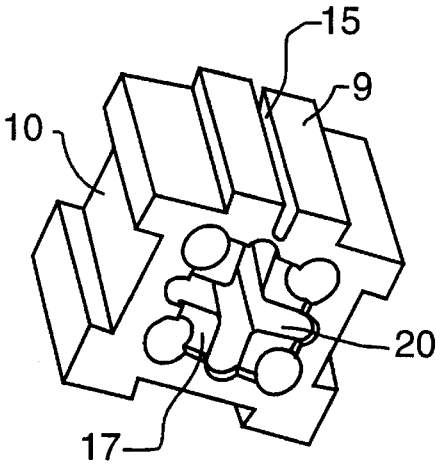
FIG. 2 is a perspective view of one of the most useful block configurations.

FIG. 2 shows one of the most useful block configurations. A cross-shaped slot 20 is provided, extending through opposite faces of the block, and dovetail connections are provided on the other four faces of the block. The dovetail connections are provided by means of male and female dovetail portions, namely a male portion 9 projecting outwardly and corresponding female portions 10. The illustrated block has three female and one male dovetail portions, although obviously that could be varied as desired.

In the embodiments shown here, the dovetails have straight walls. However, it should be appreciated that the walls need not be straight; "dovetail" is used here in the general sense, intended to cover any dovetail-like connection where one part slide into engagement with another by virtue of a flaring tongue of any cross-section, and a corresponding groove.

The apertures 20 permit the blocks to be positioned on the ends of a POPSICLE sticks, or, if the apertures extend right through the block, to be positioned part way along a POPSICLE stick. Preferably, the apertures are configured as a cross-shaped slot 20, thereby being capable of receiving connectors of rectangular cross-section in any one of four orientations at ninety degrees to each other, but they may also be configured as a simple slot 7, as seen in FIG. 16, for example.

Figure 3:
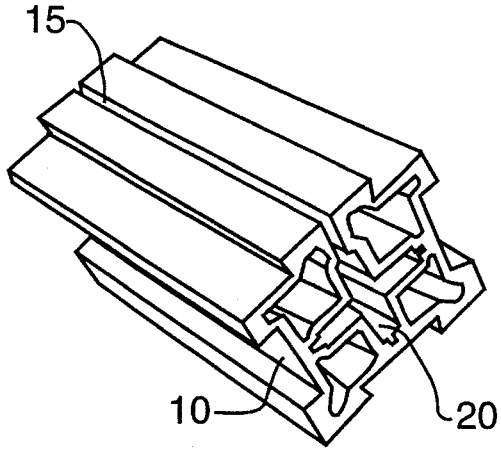

FIG. 3 shows a block which is longer than the block of FIG. 2, but which is otherwise quite similar.

Note that in both FIGS. 2 and 3, the male dovetail portion 9 is shown with a split 15. In FIG. 2, the split stops short of the cross-shaped slot, while in FIG. 3 the split carries through to the slot. The purpose of the split is to provide a little additional flexibility in the male portion, for a smoother fit into the female portion.

Figure 4:
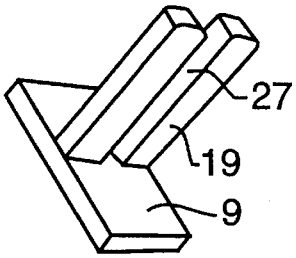
FIG. 4 is a perspective view of a simple "tongue" piece, with a male dovetail portion as well.

FIG. 4 shows a simple "tongue" piece, with a male dovetail portion 9 as well. If desired, the tongue 19 may be split by a slot 27, so that it may be inserted into parts such as that of FIG. 2, opposite another part with a tongue or opposite a POPSICLE stick, but rotated ninety degrees so that the other tongue or POPSICLE stick which is also inserted into the part fits into the slot.

The FIG. 4 piece could be inserted into a face having an aperture, such as the end face of FIG. 3, to in effect convert the face from an aperture to a male dovetail, or could be inserted into a female dovetail, to in effect convert the dovetail to a tongue.

Figure 5A:
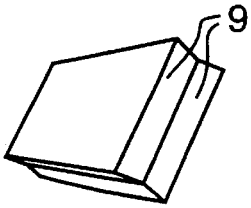
FIG. 5*a* is a perspective view of a dovetail-to-dovetail adapter.
Figure 5B:
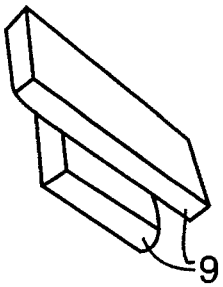
FIG. 5*b* is a perspective view of a dovetail-to-dovetail adapter, similar to the adapter of FIG. 5*a* but having one of the dovetails rotated ninety degrees.

FIG. 5*a* shows a dovetail-to-dovetail adapter, having two male dovetail portions 9. FIG. 5*b* shows a similar adapter, but having one of the dovetail portions 9 rotated ninety degrees. These pieces permit two pieces having female dovetail portions to be joined to each other.

Figure 6:
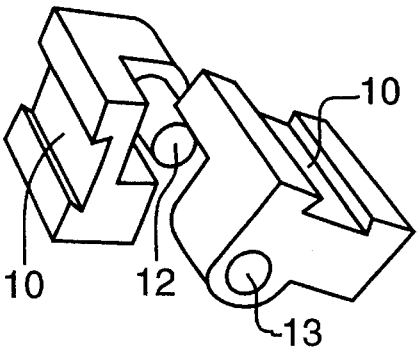
FIG. 6 is a perspective view of a hinge assembly, comprising two blocks, one having a pin and the other having a corresponding sleeve.

FIG. 6 is a perspective view of a hinge assembly, comprising two blocks, one having a pin and the other having a corresponding sleeve. A male pin 12 is offset from one block, and is adapted to mate with a female sleeve 13 incorporated into another block. The pin and sleeve preferably are slightly tapered such that a snug fit is achieved at full engagement between said pin and said sleeve. Female dovetails 10 are also provided, although other forms of connection could be used if preferred. FIG. 1 shows a hinge assembly where each piece has a tongue 19, for example.

Figure 7:
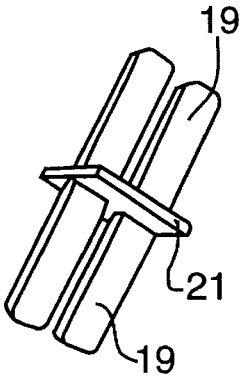
FIG. 7 is a perspective view of a double tongue piece.

FIG. 7 is a perspective view of a double tongue piece. Again, both tongues 19 are shown as slotted, although they need not necessarily be so. This piece permits two apertured faces to be joined. Preferably, at least some of the pieces have recessed areas 17 in the area of the aperture, as shown in FIG. 2, to accommodate the "plate" portion 21 of the FIG. 7 piece.

Figure 8:
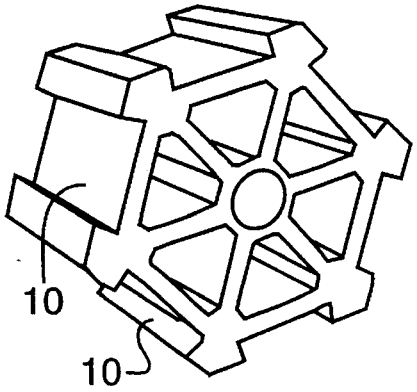
FIG. 8 is a perspective view of a hexagonal hub piece, having six dovetail portions.
Figure 9A:
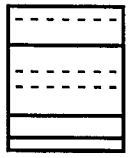
FIGS. 9*a*–9*d* are views showing a block which can interlock on six sides and hold a stick on two sides.
Figure 9B:
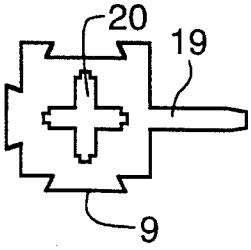
Figure 9C:
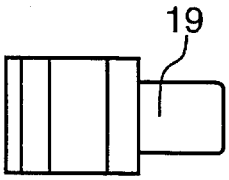
Figure 9D:
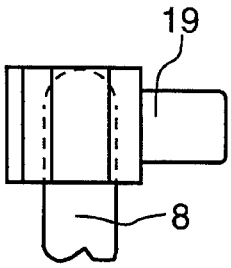
Figure 10A:
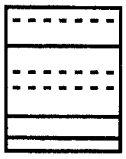
FIGS. 10*a*–10*d* are views of a block similar to that of FIG. 9, but having one side which interlocks at ninety degrees from the other side.
Figure 10B:
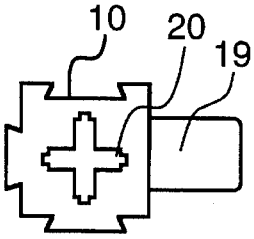
Figure 10C:
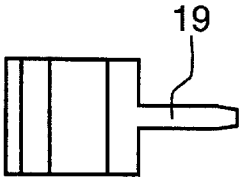
Figure 10D:
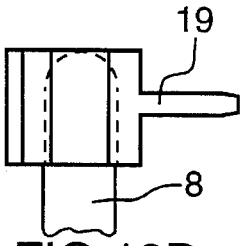
Figure 11A:
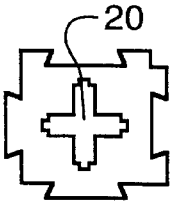
FIGS. 11*a*–11*d* are views showing a block which interlocks on five sides and holds a stick on one side or interlocks with another block.
Figure 11B:
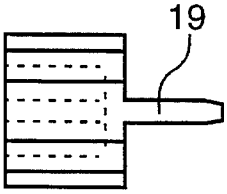
Figure 11C:
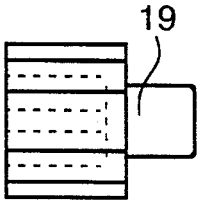
Figure 11D:
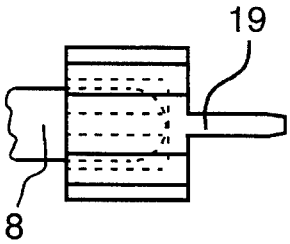
Figure 12A:
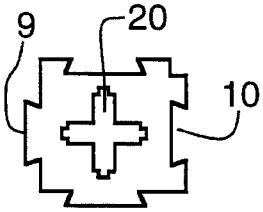
FIGS. 12*a*–12*d* are views showing a block with can interlock on two sides with similar blocks to form a strip of blocks which can hold sticks in a straight strip from two sides.
Figure 12B:
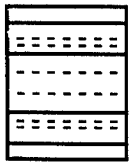
Figure 12C:
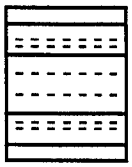
Figure 12D:
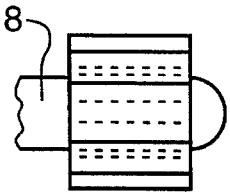

FIG. 8 is a perspective view of a hexagonal hub piece, having six female dovetail portions 10. Such a piece can be useful in structures such as FIG. 1, where the spokes are formed by using this piece as the central hub, and then building outwardly using a FIG. 4, then a FIG. 2 or FIG. 3 piece, and then a POPSICLE stick or the like.

A similar hub piece, but having six male dovetail portions 9, can be seen in FIG. 1.

FIG. 9 shows a block which has dovetail connections on three sides, a cross-shaped or cruciform slot 20 passing through the block accounting for two other sides, and an integral tongue 19 projecting from the body of the block for potential interlocking in the slot of another block. The tongue is similar in dimension to the end of a POPSICLE stick. The slot 20 can receive a POPSICLE stick, or the tongue 19 of another block, in two orientations, i.e. one at ninety degrees to the other. In the block as shown, two of the dovetail connections are male and one is female, but obviously that could be varied as desired.

FIG. 10 shows a block which is similar to FIG. 9, except that the tongue 19 is oriented ninety degrees differently from the tongue in FIG. 9.

FIG. 11 shows a block which has dovetail connections on four sides, a tongue 19 on a fifth side, and a cruciform slot 20 on a sixth side, to receive a POPSICLE stick or a tongue from another block.

FIG. 12 shows a block which is similar to the FIG. 11 block, but which has no tongue. The block can interlock with similar blocks to form a strip of blocks which can hold sticks in a straight strip from two sides, so as to form a wall structure, for example.

Figure 13A:
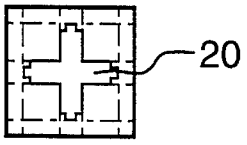
FIGS. 13*a*–13*b* are views showing a continuous block which can tack a stick or interlock on four sides with the blocks shown in FIGS. 9–11.
Figure 13B:
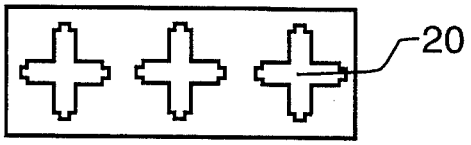

FIG. 13 shows a block which can receive POPSICLE sticks or tongues 19 of blocks such as those shown in FIGS. 9–11, on two opposite sides and both ends.

Figure 14A:
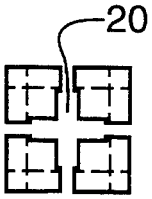
FIGS. 14*a*–14*b* are views of a block similar to the FIG. 13 block except the end openings are slotted to show an alternate type of opening.
Figure 14B:
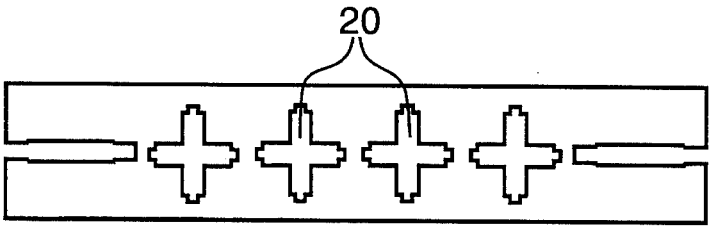

FIG. 14 is similar to FIG. 13 except that the openings adjacent each end of the block are slotted to show an alternate type of opening, i.e. a straight slot 7 as opposed to the cruciform shape.

Figure 15A:
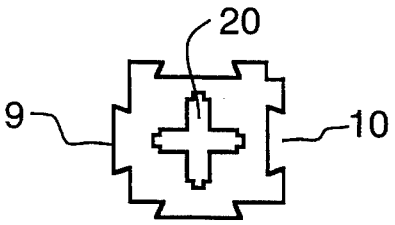
FIGS. 15*a*–15*b* are views of a block similar to the FIG. 12 block except that it is longer, to couple two sticks or blocks of the type shown in FIGS. 9–11.
Figure 15B:
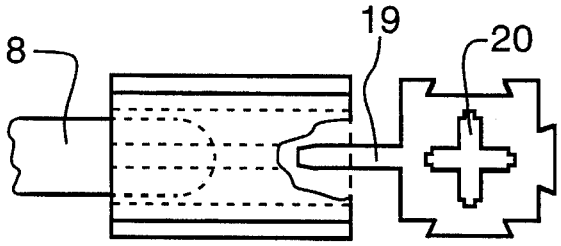
Figure 16A:
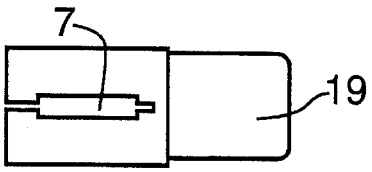
FIGS. 16*a*–16*i* show a block with interconnecting means on one side, to hold sticks or interlock in one direction on four sides, and interlock or hold a stick in a cross-shaped slot on the remaining side.
Figure 16B:
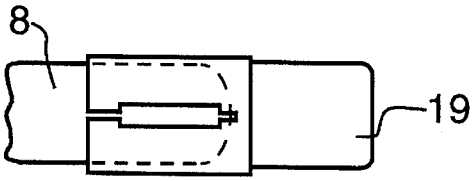
Figure 16C:
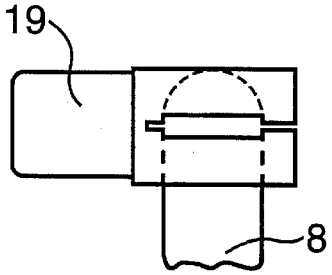
Figure 16D:
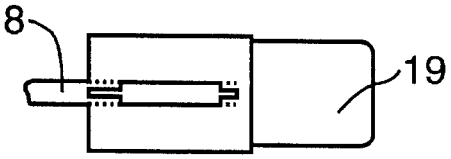
Figure 16E:
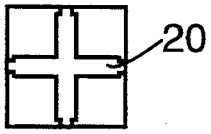
Figure 16F:
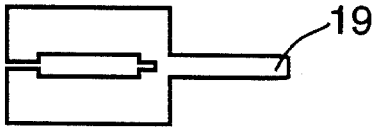
Figure 16G:
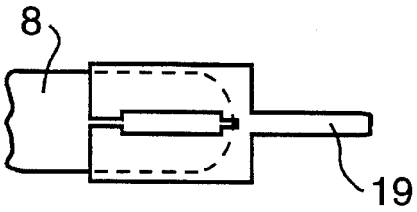
Figure 16H:
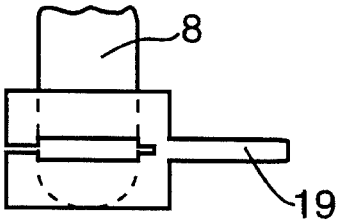
Figure 16I:
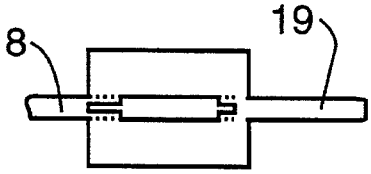
Figure 17A:
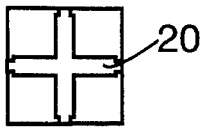
FIGS. 17*a*–17*e* show a block similar to that of FIG. 16 except that it can interlock at a swivel.
Figure 17B:
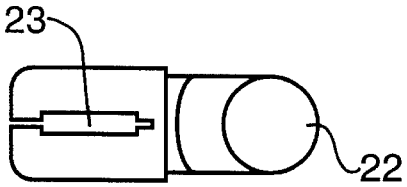
Figure 17C:
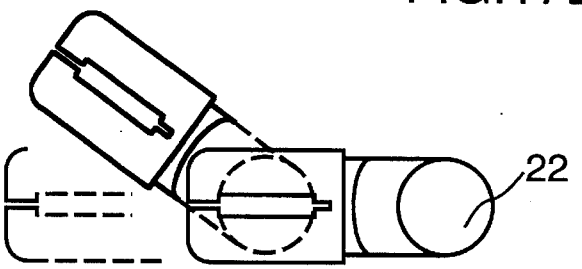
Figure 17D:
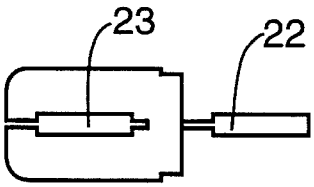
Figure 17E:
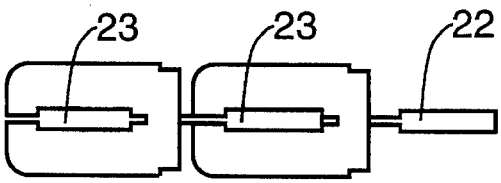
Figure 18A:
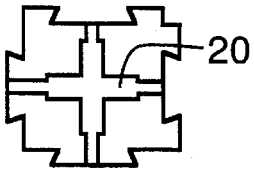
FIGS. 18*a*–18*d* show a block which interlocks on five sides, holds a stick on four sides in one direction and interlocks or holds a stick in two directions on the remaining side.
Figure 18B:
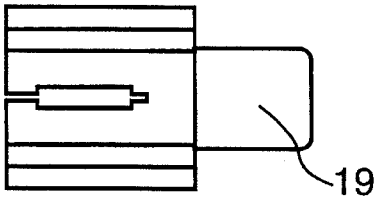
Figure 18C:
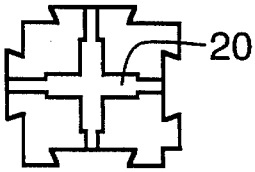
Figure 18D:
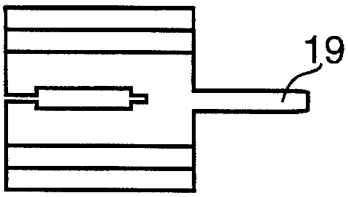

FIG. 15 shows a block which is similar to the FIG. 12 block except that it has a longer body in order to couple two sticks or blocks of the FIG. 9–11 type, as shown.

FIG. 16 shows a block with a tongue 19 on one side for interconnection with other blocks having slots. The block can hold sticks or interlock in one direction on four sides, by virtue of straight slots 7, and can interlock or hold a stick in two direction on the remaining side, by virtue of the cruciform slot 20.

FIG. 17 shows a block which is similar to the FIG. 16 block, except that it can interlock via a swivel joint, by virtue of disk portion 22 and a corresponding circular opening 23.

FIG. 18 shows a block which has a tongue 19 projecting from one side, and which can interlock on the remaining five sides, i.e. it can hold a stick in one direction on four sides by virtue of straight slots 7, and it can hold a stick in two directions on the remaining side by virtue of cruciform slot 20. Dovetail connections are also provided, as shown. Again, any desired combination of male and female dovetail connections could be provided.

Figure 19:
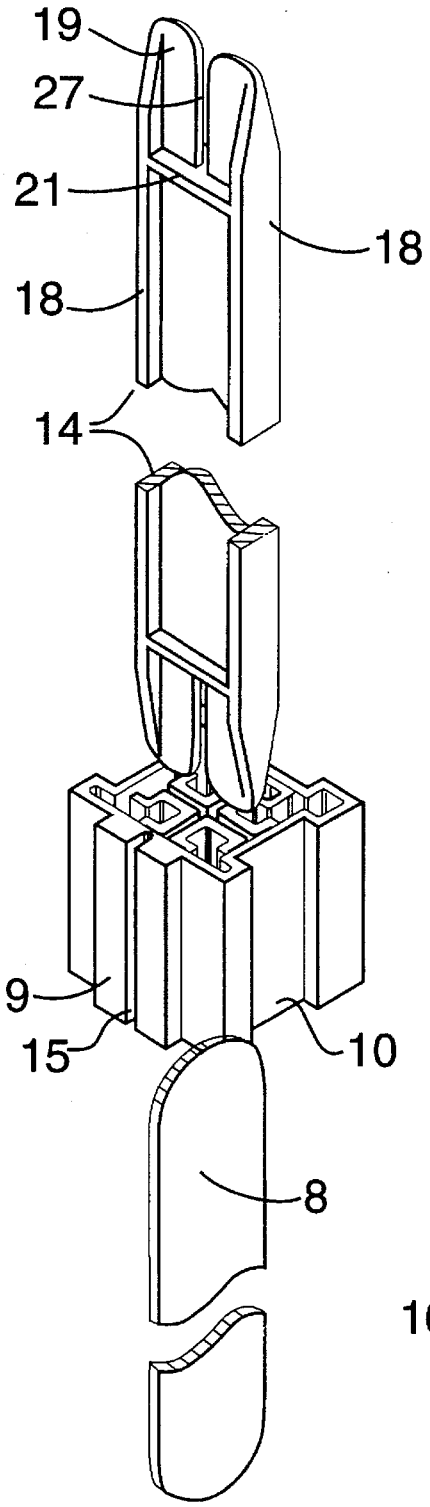
FIG. 19 is a perspective view showing a block similar to the FIG. 2 type of block, but having T-shapes at each end of the slots, and showing an elongated connector piece which is H-shaped in cross-section, and a POPSICLE stick.

FIG. 19 is a perspective view showing a block similar to the FIG. 2 type of block, but having T-shapes 25 (see FIG. 21A) at each end of the slots 20, and showing an elongated connector piece 14 which is H-shaped in cross-section by virtue of reinforcing side walls 18, and a POPSICLE stick 8. A plate portion 21 spans between the side walls, and is intended to abut the block to ensure proper location of the connector. The plate portion is accommodated within recessed area 17, so that blocks connected by the connectors can abut each other directly, rather than being separated by the thickness of the plate portion.

Figure 20:
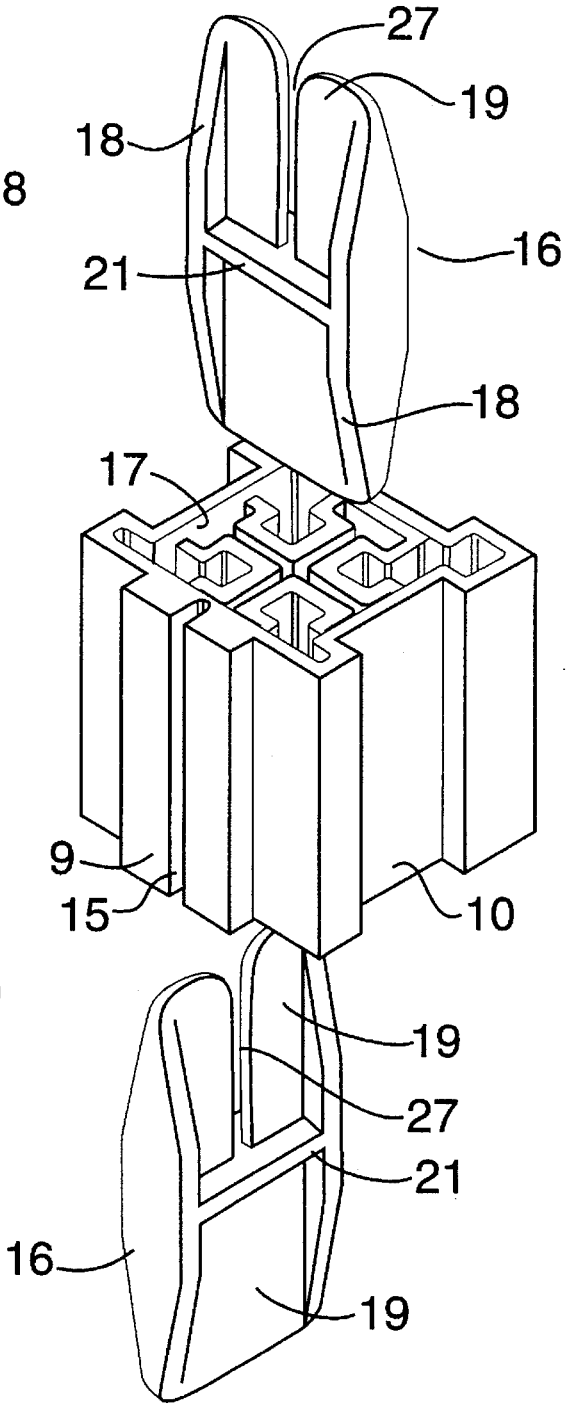
FIG. 20 is a perspective view similar to FIG. 19, showing the same block as in FIG. 19, and two short connector pieces which are H-shaped in cross-section.

FIG. 20 is a perspective view similar to FIG. 19, showing two short connector pieces 16 which are H-shaped in cross-section. They are essentially short versions of the elongated connector piece 14 shown in FIG. 19. Preferably the tongue 19 is split by a slot 27. Thus, as can be seen from FIG. 20, two connector pieces may be inserted in opposite ends of the same block, at ninety degrees to each other.

FIGS. 21A to 21D show a building block having six faces, namely four side faces and two end faces. At least two adjacent side faces, and preferably all four side faces, have either a dovetail tongue 9 (preferably with a split 15) running therealong for engagement with a corresponding dovetail groove 10 on another block or combination of blocks, or a dovetail groove running therealong for engagement with a corresponding dovetail tongue on another block or combination of blocks, such that one block slidably engages with another block or combination of blocks. Particular dimensions are employed in order that a matrix of blocks may be formed, conceivably much larger than the simple matrix shown in FIG. 21. Individual blocks could have 4/0[male/female] dovetails, or 3/1, or 2/2, or 1/3, or 0/4, as desired.

Figure 21A:
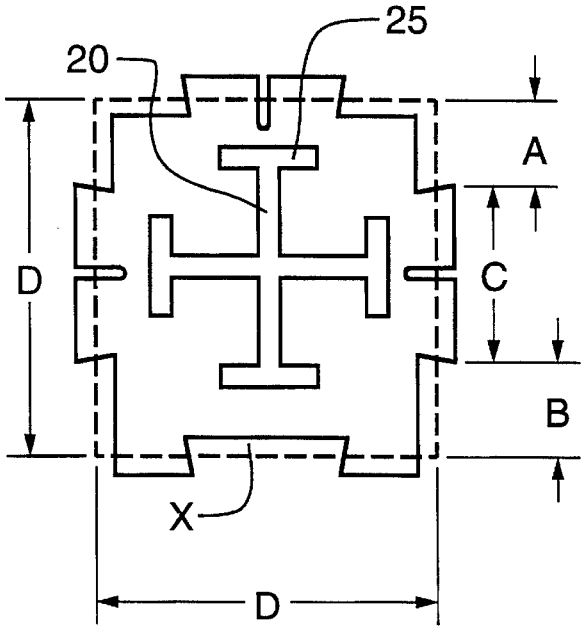
FIGS. 21A–21D shows a block which has complementary dovetail faces configured such that a matrix of such blocks may be formed.
Figure 21B:
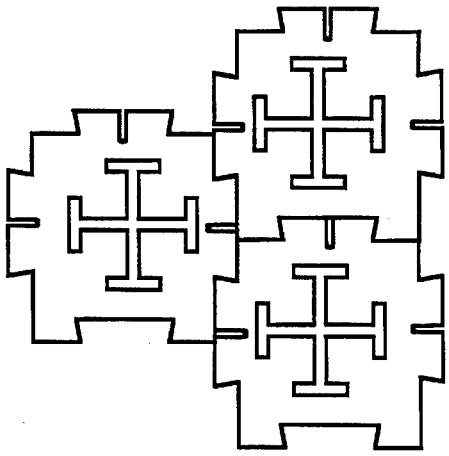
Figure 21C:
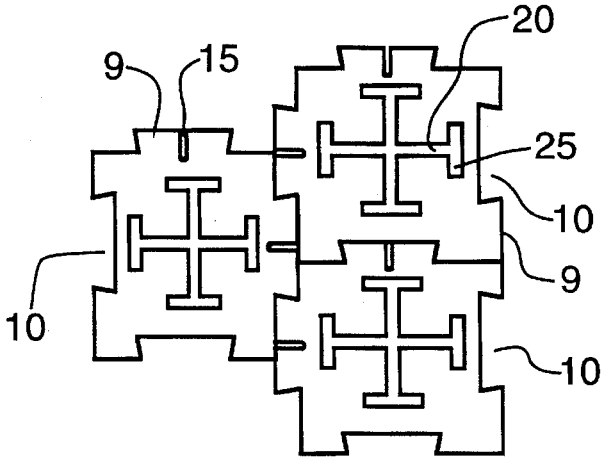
Figure 21D:
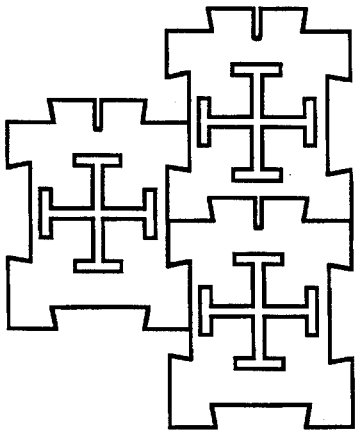

The dimensions of the block are defined as follows. A nominal square of side dimension d is defined by notional lines drawn parallel to the side faces through midheight or middepth points of the dovetail tongues or dovetail grooves as the case may be. The further dimensions of the block, as illustrated in FIG. 21A, are in accordance with the formulae:

$$A+B=C$$

$$A+B+C=D$$

where A is the distance from one edge of the dovetail tongue or dovetail groove at the midheight or middepth thereof to its adjacent edge of said nominal square; B is the distance from the opposite edge of the dovetail tongue or dovetail groove at the midheight or middepth thereof to its adjacent edge of said nominal square; and C is the width of the dovetail tongue or dovetail groove at the midheight or middepth thereof. Each dovetail tongue or dovetail groove is centered on the face of the nominal square, D being the length of each side of the square.

Further analysis of the above shows that A=B, and thus that 2A=C or 2B=C, or 4A=D or 4B=D, etc.. It should be emphasized that these dimensions are all nominal, rather than precise. In practice, sufficient allowance must be made for normal tolerances and for drafts in the mold to ensure that the mold can come apart and that the parts will slidably engage each other without either too much or too little friction or play.

Figure 22A:
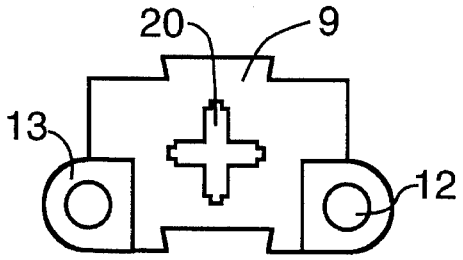
FIGS. 22a–22b show a block with hinges similar to FIG. 1, but with slots as in FIGS. 9–15.
Figure 22B:
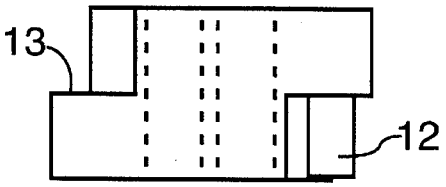
Figure 23A:
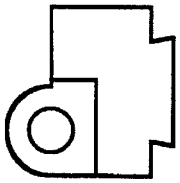
FIGS. 23*a*–23*g* show a piece with hinges similar to FIG. 1, but having a tongue projecting therefrom as in FIG. 9.
Figure 23B:
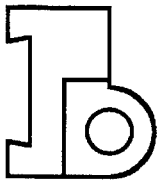
Figure 23C:
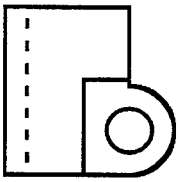
Figure 23D:
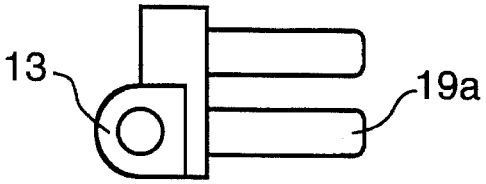
Figure 23E:
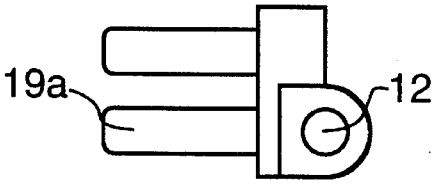
Figure 23F:
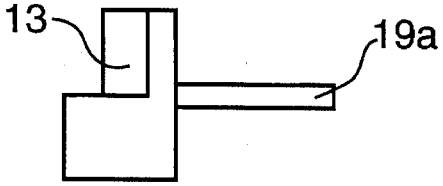
Figure 23G:
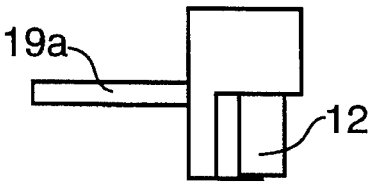

FIGS. 22*a*–22*b* show a block with hinges similar to FIG. 1, but with cruciform slots 20 as in FIGS. 9–15. These blocks could have the modified slots which T-shaped ends, as in FIG. 21A, if so desired. These blocks would then be quite similar to the blocks of FIG. 33A.

FIGS. 23*a*–23*g* show especially useful pieces with hinges similar to FIG. 1, but having tongues 19 projecting therefrom as in FIG. 9. FIG. 23 also illustrates that the tongue may be split by a slot 27, so that it may be inserted into parts such as those of FIGS. 22, 24 or 25 (and others) opposite another part with a tongue or opposite a POPSICLE stick, rotated ninety degrees so that the other tongue or POPSICLE stick which is also inserted into the part fits into the slot. The tongue could be rotated ninety degrees. Reinforced tongues similar to the connectors 14 and 16 in FIGS. 19 and 20 could also be used.

Figure 24:
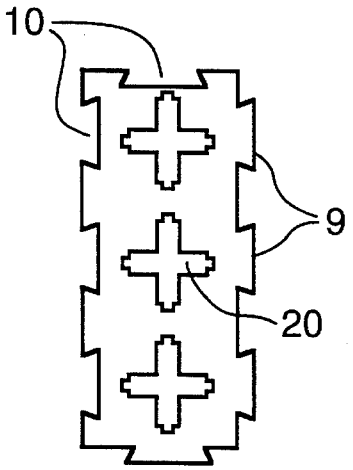
FIG. 24 shows a piece similar to FIG. 13, but with a dovetail arrangement as in FIG. 1.

FIG. 24 shows a piece similar to FIG. 13, but with a dovetail arrangement as in FIG. 1.

Figure 25:
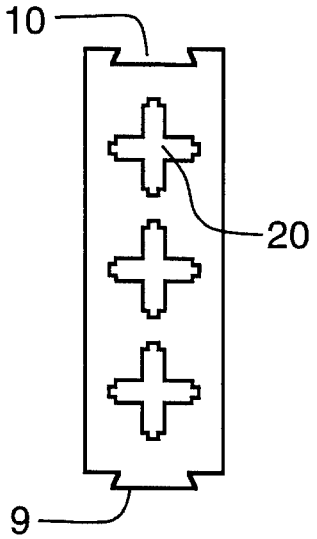
FIG. 25 shows a piece similar to that in FIG. 24, but with dovetails at the ends only.

FIG. 25 shows a piece similar to that in FIG. 24, but with dovetails at the ends only.

Figure 26A:
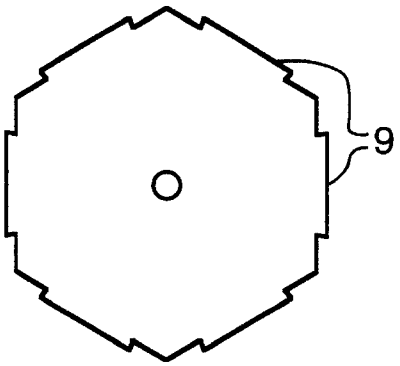
FIGS. 26*a*–26*b* show a hub as in FIG. 6, but with a dovetail.
Figure 26B:
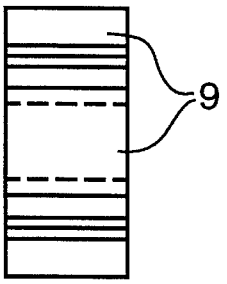
Figure 27A:
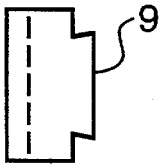
FIGS. 27*a*–27*g* show pieces which combine a dovetail and a tongue.
Figure 27B:
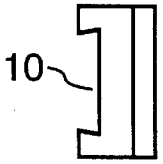
Figure 27C:
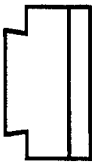
Figure 27D:
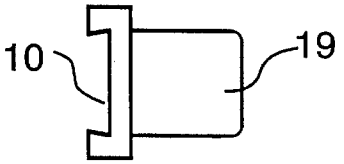
Figure 27E:
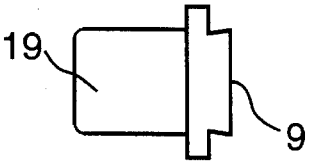
Figure 27F:
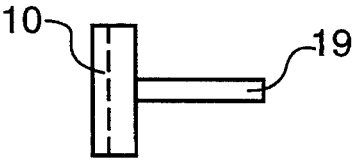
Figure 27G:
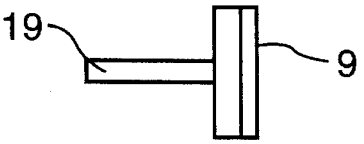

FIGS. 26*a*–26*b* show a hub as in FIG. 6, but with a dovetail.

FIGS. 27*a*–27*g* show pieces which combine a dovetail and a tongue. The tongue could be rotated ninety degrees, and could be split if desired (as in FIG. 23). Reinforced tongues similar to the connectors 16 and 18 in FIGS. 19 and 20 could also be used.

Figure 29:
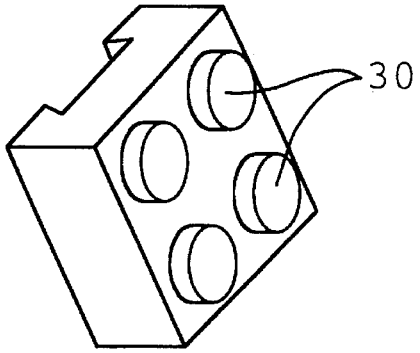
FIG. 29 is a perspective view of a piece having a LEGO (trademark) type of connection, along with a female dovetail connection.

FIG. 29 is a perspective view of a piece having a connection 30 of the LEGO (trademark) type, along with a female dovetail connection 10.

Figure 30:
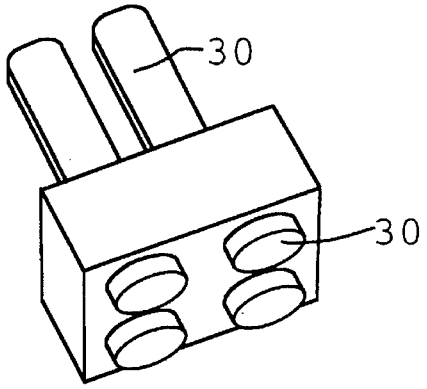
FIG. 30 is a perspective view of another piece having a LEGO (trademark) type of connection, along with a tongue portion.

FIG. 30 is a perspective view of another piece having a LEGO (trademark) type of connection, along with a slotted tongue 19.

The blocks of FIGS. 29 and 30 obviously could employ female LEGO-type connectors instead of male connectors.

Figure 31:
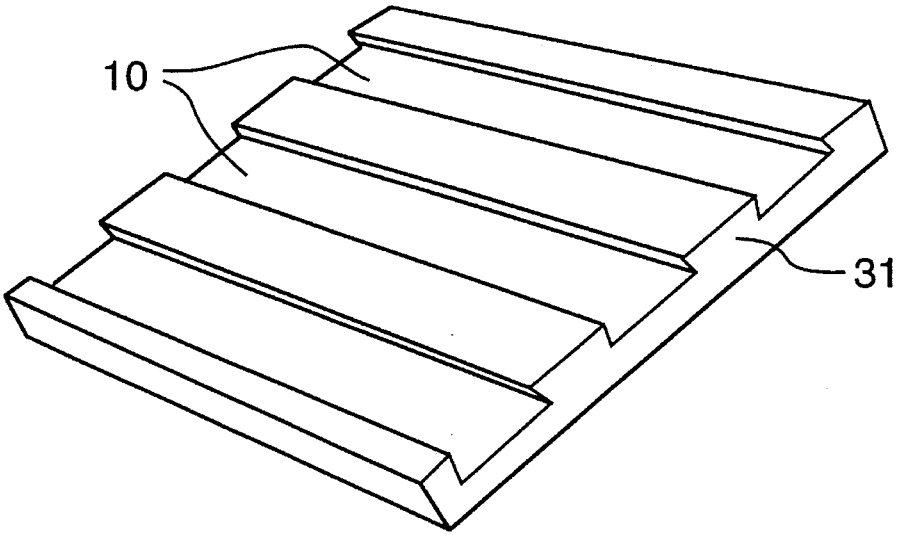
FIG. 31 shows a planar base with several female dovetail grooves, to act as a base for a structure.

FIG. 31 shows a planar base 31 with several female dovetail grooves, to act as a base for a structure.

Figure 32:
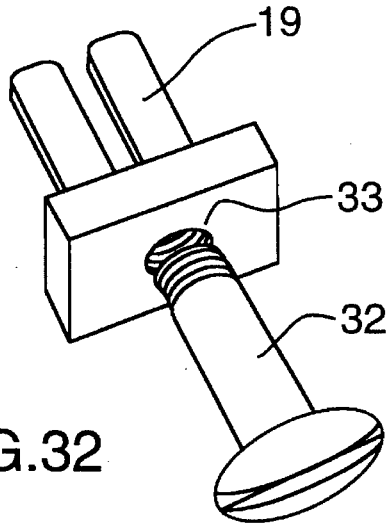
FIG. 32 shows a spindle assembly for use as an axle to mount wheels on a toy vehicle, for example.

FIG. 32 shows a spindle assembly for use as an axle to mount wheels on a toy vehicle, for example. The assembly includes a piece with a tongue 19, and an "axle" 32 which threads into a hole 33 in the piece.

Figure 33A:
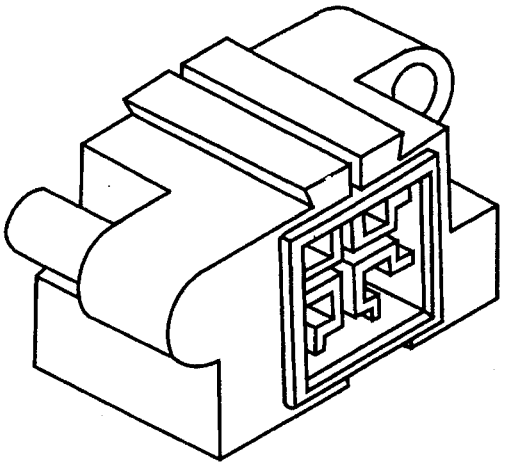
FIGS. 33A and 33B are perspective views of blocks which combine dovetails, hinges, and LEGO-type connections.
Figure 33B:
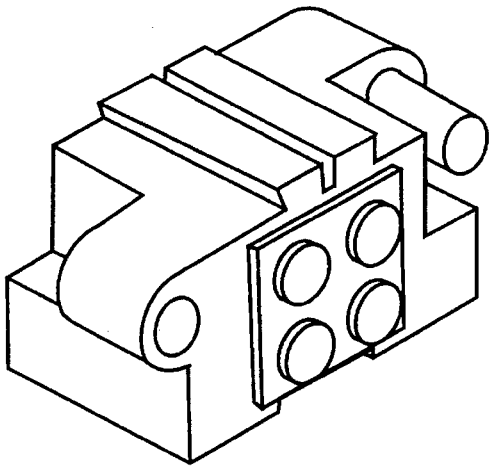

FIGS. 33A and 33B are perspective views of blocks which combine dovetails, hinges, and LEGO-type connections. It should be obvious that both male and female LEGO-type connections could be employed.

Figure 34A:
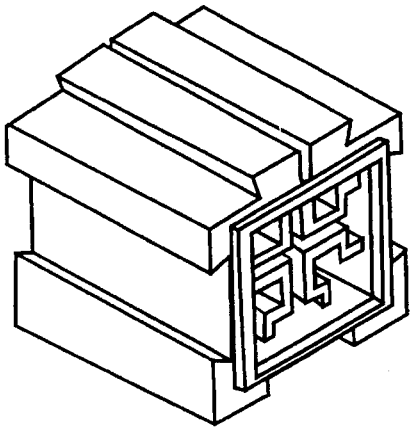
FIGS. 34A and 34B are perspective views of blocks which combine dovetails and LEGO-type connections.
Figure 34B:
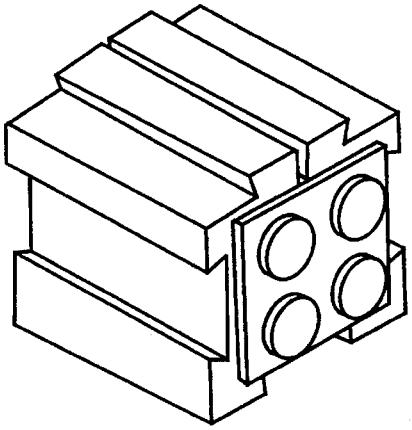

FIGS. 34A and 34B are perspective views of blocks which combine dovetails and LEGO-type connections.

With the wide variety of block configurations such as those described above, it should be apparent that a very large number of structures could be assembled, from the simple to the complex.

Figure 28:
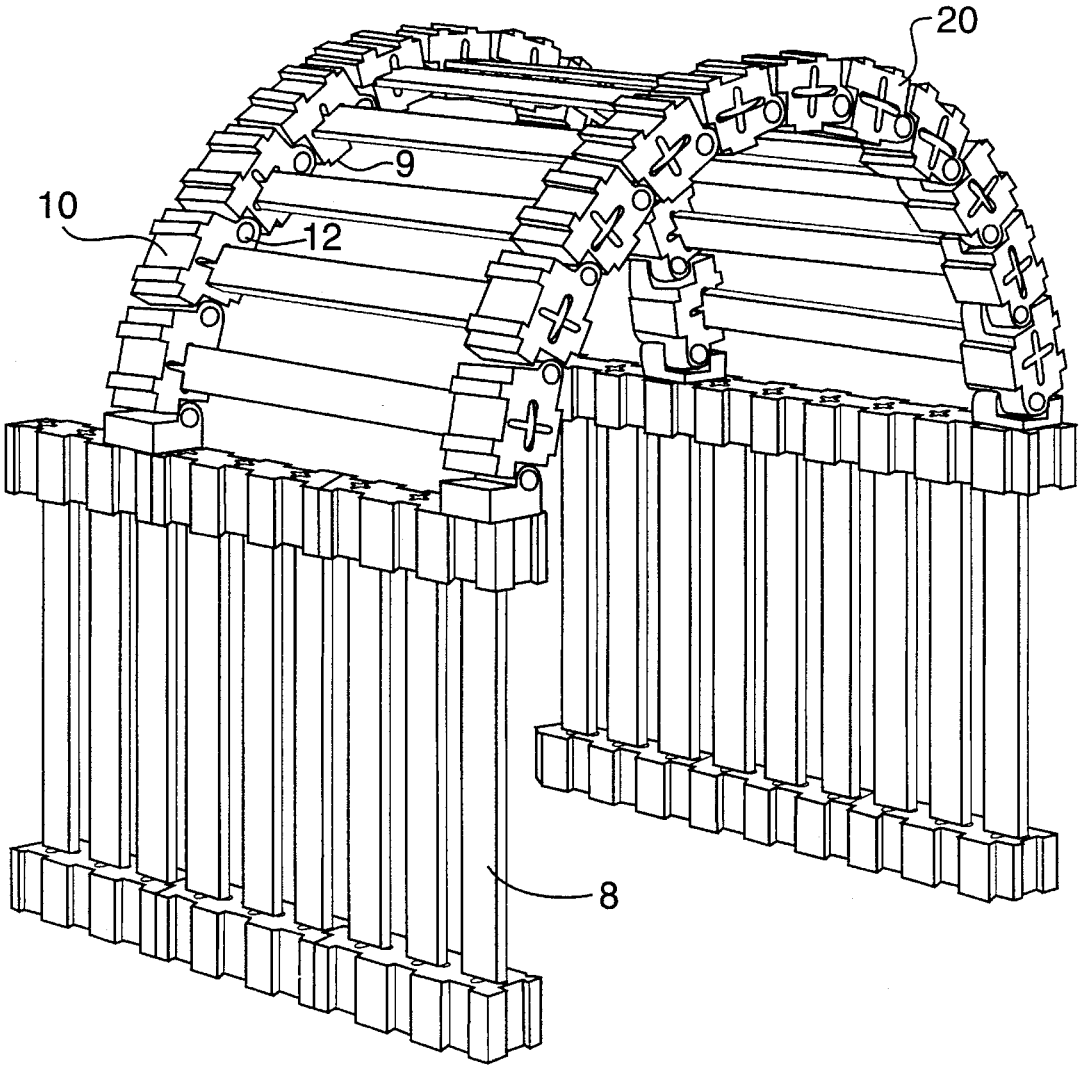
FIG. 28 shows an arch structure assembled from various components.

For example, FIG. 28 shows an arch structure. Complex structures such as a geodesic dome could probably be assembled with the correct hub and hinge pieces. These are just two examples, and are not intended to be limiting in any way.

It will be appreciated that the above description relates to preferred embodiments by way of example only. Many variations on the invention will be obvious to those knowledgeable in the field.

For example, it must be emphasized once again that the above-described embodiments are illustrative examples only; the various features of the blocks as described above could obviously be combined in very many different ways other than those illustrated here.

As one example only, dovetail sections 9 and 10 could replace tongues 19 in the blocks of FIGS. 9–11. They could be straight, or at any angle.

Various features could be straight, or at an angle; a generally cubic configuration is not strictly essential.

A block could be provided with a male or female dovetail on one or more faces, and a male or female hinge on one or more other faces.

Generally, almost any combination of male hinge, female hinge, male dovetail, female dovetail, tongue 19 (split or otherwise), slot (cruciform or straight), pivot connections as in FIG. 17, or other forms of connection such as in FIG. 19 could be designed, thus providing a wide variety of construction options.

Furthermore, in addition to the interlocking means described above, it is envisioned that many other forms of interconnection for the blocks could be used. For example, for fixed connections between the blocks, a LEGO-type connection could be used. For hinged connection, other suitable hinge mechanisms could conceivably be used, such as a ZAKS-type connection, for example.

It should also be made clear that although the invention is particularly adapted for use with POPSICLE sticks, any other connector or framing piece could be used. For example, small diameter sticks could be used as in the TINKERTOY construction sets, with the blocks being provided with corresponding circular holes instead of the POPSICLE stick slots 7.

From FIG. 28, it can also be readily envisioned that a single unit could be produced which in one piece could provide the equivalent of the row of blocks shown across the bottom of FIG. 28, just as with LEGO blocks there are pieces of varying sizes and lengths. In the case of such a unit, hinge pins and sleeves could still be provided at the ends of the unit, but there would be multiple slots and dovetail connections spaced along the unit.

It is preferable to have alternate configurations of the blocks in which the connection means are rotated relative to each other, again to provide a wider variety of interconnection options. Compare FIGS. 5*a* and 5*b*, for example.

These and other such obvious variations are within the scope of the invention as described and claimed, whether or not expressly described.

What is claimed as the invention is:

1. A toy construction kit, comprising a plurality of building pieces of various configurations, including building pieces each having six faces, each one of said six faces having interconnection means configured for direct connection to complementary interconnection means on other building pieces, said interconnection means in at least one of said faces comprising an aperture defined therein, particularly sized and shaped to receive a connector member in said kit from the group consisting of a planar, essentially rectangular cross-section elongate element and a planar, essentially rectangular cross-section tongue integral with and extending from another building piece, said other faces each having other interconnection means, including at least two selected from the group consisting of:

(a) a pin parallel to a face of the piece, particularly sized to engage a corresponding sleeve on another piece, for hinged connection such that one piece may rotate with respect to another piece;

(b) a sleeve parallel to a face of the piece, particularly sized to engage a corresponding pin on another piece, for hinged connection such that one piece may rotate with respect to another piece;

(c) a male dovetail on a face of the piece, particularly sized to engage a corresponding female dovetail on another piece such that one piece slidably engages with another piece;

(d) a female dovetail on a face of the piece, particularly sized to engage a corresponding male dovetail on another piece such that one piece slidably engages with another piece; and (e) a tongue of rectangular cross-section projecting from a face of the piece, particularly sized to engage one of said apertures.

2. A toy construction kit as recited in claim 1, where at least some of said six-faced building pieces have four side faces and two opposite end faces, said opposite end faces each having one of said apertures.

3. A toy construction kit as recited in claim 2, where four side faces each have one of said other interconnection means, not all four of said side faces having the same said other interconnection means.

4. A toy construction kit as recited in claim 2, where each one of said side faces has a dovetail element running therealong, particularly sized to engage a corresponding dovetail element on another piece such that one piece slidably engages with another piece.

5. A toy construction kit as recited in claim 4, where said dovetail elements include both male and female.

6. A toy construction kit as recited in claim 1, where said kit further includes adapter pieces having two generally parallel faces in close proximity to each other, said faces of said adapter pieces each having interconnection means selected from the group consisting of:

(a) a pin parallel to the face, particularly sized to engage a corresponding sleeve on another piece, for hinged connection such that one piece may rotate with respect to another piece;

(b) a sleeve parallel to the face, particularly sized to engage a corresponding pin on another piece, for hinged connection such that one piece may rotate with respect to another piece;

(c) a male dovetail on the face, particularly sized to engage a corresponding female dovetail on another piece such that one piece slidably engages with another piece;

(d) a female dovetail on the face, particularly sized to engage a corresponding male dovetail on another piece such that one piece slidably engages with another piece; and (e) a tongue of rectangular cross-section projecting at a right angle from the face, particularly sized to engage one of said apertures;

whereby said building pieces having six faces may have the interconnection means on any given face effectively changed by attaching a complementary one of said adapter pieces thereto, and whereby two building pieces being otherwise unconnectable due to incompatible interconnections means may be connected via one of said adapter pieces, whereby a larger building unit can be created from otherwise incompatible building pieces.

7. A toy construction kit as recited in claim 6, where said adapter pieces include pieces with said tongues projecting from one said face, the other said face having interconnection means selected from the group consisting of:

(a) a pin parallel to the face, particularly sized to engage a corresponding sleeve on another piece, for hinged connection such that one piece may rotate with respect to another piece;

(b) a sleeve parallel to the face, particularly sized to engage a corresponding pin on another piece, for hinged connection such that one piece may rotate with respect to another piece;

(c) a male dovetail on the face, particularly sized to engage a corresponding female dovetail on another piece such that one piece slidably engages with another piece; and (d) a female dovetail on the face, particularly sized to engage a corresponding male dovetail on another piece such that one piece slidably engages with another piece;

whereby said building pieces having six faces may have the type of interconnection means on any given face effectively changed by attaching one of said adapter pieces, to change a face having an aperture into a face having an interconnection means selected from the above group, or to change a face having other interconnection means into a face having a tongue.

8. A toy construction kit as recited in claim 6, where said adapter pieces include pieces comprising two said dovetails, one on each said face.

9. A toy construction kit as recited in claim 6, where said adapter pieces include pieces comprising a dovetail and a tongue, one on each said face.

10. A toy construction kit as recited in claim 6, further comprising at least two adapter pieces for providing hinged connections between two building pieces, one said adapter piece having a pin projecting therefrom, particularly sized to engage a corresponding sleeve incorporated in the other adapter piece, and each of said adapter pieces having at least one other face having interconnection means for engagement with complementary interconnection means on another building piece, said hinged connections thereby providing for hinged connection whereby one building piece or building unit may rotate with respect to another building piece or building unit.

11. A toy construction kit as recited in claim 1, further including planar, elongated connectors having a rectangular cross-section identical to that of said tongues, said elongated connectors being at least five times as long as any dimension of said building pieces having six faces, such that said elongated connectors may be used to connect remote blocks via said apertures.

12. A toy construction kit as recited in claim 1, where said aperture in at least some of said building pieces is cross-shaped, thereby being capable of receiving connectors of rectangular cross-section in any one of four orientations at ninety degrees to each other.

13. A toy construction kit as recited in claim 9, where said cross-shaped aperture passes entirely through the building piece from end to end.

14. A toy construction kit as recited in claim 1, where at least some of said tongues have a longitudinal split therein along a central axis thereof.

15. A toy construction kit as recited in claim 1, comprising building pieces where at least two adjacent side faces have either a dovetail tongue running therealong for engagement with a corresponding dovetail groove on another building piece or combination of building pieces, or a dovetail groove running therealong for engagement with a corresponding dovetail tongue on another building piece or combination of building pieces, such that one building piece slidably engages with another building piece or combination of building pieces, in which a nominal square of side dimension D is defined by notional lines drawn parallel to said side faces through midheight or middepth points of said dovetail tongues or dovetail grooves as the case may be, the further dimensions of said building piece, ignoring minor allowances for tolerances and mold draft, being substantially in accordance with the formulae:

$$A+B=C$$

and $$A+B+C=D$$

where:

A is the distance from one edge of the dovetail tongue or dovetail groove at the midheight or middepth thereof to its adjacent edge of said nominal square;

B is the distance from the opposite edge of the dovetail tongue or dovetail groove at the midheight or middepth thereof to its adjacent edge of said nominal square;

C is the width of the dovetail tongue or dovetail groove at the midheight or middepth thereof;

and where each said dovetail tongue or dovetail groove is centered on the face of said nominal square.

16. A toy construction kit as recited in claim 15, where all four side faces have either a dovetail tongue or a dovetail groove running therealong.

17. A toy construction kit as recited in claim 1, comprising building pieces where each face having one of said apertures has a portion of said face recessed from the outer periphery of said face.

18. A toy construction kit, comprising a plurality of building pieces of various configurations, including building pieces each having six faces, each one of said six faces having interconnection means configured for direct connection to complementary interconnection means on other building pieces, said interconnection means in at least one of said faces comprising an I-shaped aperture defined therein, particularly sized and shaped to receive a connector member in said kit from the group consisting of an essentially I-shaped cross-section elongate element and an essentially I-shaped cross-section tongue integral with and extending from another building piece, said other faces each having other interconnection means, including at least two selected from the group consisting of:

(a) a pin parallel to a face of the piece, particularly sized to engage a corresponding sleeve on another piece, for hinged connection such that one piece may rotate with respect to another piece;

(b) a sleeve parallel to a face of the piece, particularly sized to engage a corresponding pin on another piece, for hinged connection such that one piece may rotate with respect to another piece;

(c) a male dovetail on a face of the piece, particularly sized to engage a corresponding female dovetail on another piece such that one piece slidably engages with another piece;

(d) a female dovetail on a face of the piece, particularly sized to engage a corresponding male dovetail on another piece such that one piece slidably engages with another piece; and (e) a tongue of rectangular cross-section projecting from a face of the piece, particularly sized to engage one of said apertures.

19. A toy construction kit as recited in claim 18, where there are two said I-shaped apertures crossing each other at ninety degrees, thus defining a cruciform shape having four arms, with a T-shape at each end thereof, whereby a connector which is I-shaped in cross-section may be received in any one of four orientations at ninety degrees to each other.

20. A toy construction kit as recited in claim 19, including said I-shaped connectors, said connectors each having an I-shaped cross-section defined by a main web and two end arms, and a cross-web spanning between arms partway along said main web.

* * * * *